US010927772B2

(12) United States Patent
Suzuki et al.

(10) Patent No.: US 10,927,772 B2
(45) Date of Patent: Feb. 23, 2021

(54) CONTROL METHOD FOR INTERNAL COMBUSTION ENGINE, AND CONTROL SYSTEM FOR INTERNAL COMBUSTION ENGINE

(71) Applicant: Nissan Motor Co., Ltd., Kanagawa (JP)

(72) Inventors: Kenji Suzuki, Kanagawa (JP); Tomoki Itou, Kanagawa (JP); Yukiyo Yamada, Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 16/643,439

(22) PCT Filed: Aug. 30, 2017

(86) PCT No.: PCT/JP2017/031059
§ 371 (c)(1),
(2) Date: Feb. 28, 2020

(87) PCT Pub. No.: WO2019/043808
PCT Pub. Date: Mar. 7, 2019

(65) Prior Publication Data

US 2020/0362773 A1 Nov. 19, 2020

(51) Int. Cl.
*F02D 41/06* (2006.01)
*F02D 15/00* (2006.01)
(Continued)

(52) U.S. Cl.
CPC ..... *F02D 15/00* (2013.01); *F02D 41/024* (2013.01); *F02D 41/1446* (2013.01);
(Continued)

(58) Field of Classification Search
CPC .... F02D 15/00; F02D 41/1446; F02D 41/024; F02D 41/16; F02D 2200/023; F02D 2200/0802; F02D 2200/602
(Continued)

(56) References Cited

U.S. PATENT DOCUMENTS

2010/0294245 A1 11/2010 Yoshioka et al.
2016/0131091 A1 5/2016 Kaneko et al.

FOREIGN PATENT DOCUMENTS

JP 2006-070863 A 3/2006
JP 2007-064153 A 3/2007
(Continued)

*Primary Examiner* — Hai H Huynh
(74) *Attorney, Agent, or Firm* — Osha Bergman Watanabe & Burton LLP

(57) ABSTRACT

A control method for an internal combustion engine including a variable compression ratio mechanism which includes: implementing a compression ratio fixing control in which a mechanical compression ratio is fixed to a predetermined low compression ratio, and controlling combustion form in a cylinder to stratified combustion, under engine idling during catalyst warming-up; controlling the combustion form in the cylinder to homogeneous combustion, under an operation state other than the engine idling during the catalyst warming-up; and implementing the compression ratio fixing control and controlling the combustion form in the cylinder to the homogeneous combustion, in response to pressing-down of an accelerator under the engine idling during the catalyst warming-up, and as long as the engine idling during the catalyst warming-up has a possibility to resume in response to release of the accelerator after the pressing-down.

5 Claims, 3 Drawing Sheets

(51) Int. Cl.
*F02D 41/16* (2006.01)
*F02D 41/14* (2006.01)
*F02D 41/02* (2006.01)

(52) U.S. Cl.
CPC ..... *F02D 41/16* (2013.01); *F02D 2200/023* (2013.01); *F02D 2200/0802* (2013.01); *F02D 2200/602* (2013.01)

(58) Field of Classification Search
USPC ..... 123/339.1, 436, 680, 685, 687, 48 R; 701/110–113
See application file for complete search history.

(56) References Cited

FOREIGN PATENT DOCUMENTS

| | | | |
|---|---|---|---|
| JP | 2008-111375 | A | 5/2008 |
| JP | 2010-007574 | A | 1/2010 |
| JP | 2012-102671 | A | 5/2012 |
| JP | 2017-044121 | A | 3/2017 |
| WO | 2009/091077 | A1 | 7/2009 |
| WO | 2014/196267 | A1 | 12/2014 |

CONTROL METHOD FOR INTERNAL COMBUSTION ENGINE, AND CONTROL SYSTEM FOR INTERNAL COMBUSTION ENGINE

TECHNICAL FIELD

The present invention relates to a control method for internal combustion engine, and a control system for internal combustion engine.

BACKGROUND ART

Patent Document 1 discloses: in an internal combustion engine, implementing during catalyst warming-up a low compression ratio operation in which a mechanical compression ratio of the internal combustion engine is reduced to raise an exhaust temperature; and in response to a request for acceleration during the low compression ratio operation, increasing the mechanical compression ratio over that at a timing immediately before the acceleration request is determined present.

According to Patent Document 1, the low compression ratio operation is implemented again after the increase in the mechanical compression ratio in response to the acceleration request (i.e. pressing-down of an accelerator) made during the catalyst warming-up, if the accelerator is released and then the acceleration request is determined absent immediately after the increase in the mechanical compression ratio, and if the catalyst warming-up is incomplete at that timing.

In such case, the mechanical compression ratio may vary frequently, and the internal combustion engine may undergo unstable combustion.

In view of the foregoing, it is favorable to improve control for an internal combustion engine upon acceleration request made during catalyst warming-up in which a mechanical compression ratio is reduced to raise an exhaust temperature.

PRIOR ART DOCUMENT(S)

Patent Document(s)

Patent Document 1: JP 2010-007574 A

SUMMARY OF THE INVENTION

According to one aspect of the present invention, under engine idling during catalyst warming-up, an internal combustion engine is controlled in order to: implement a compression ratio fixing control in which a mechanical compression ratio of the internal combustion engine is fixed to a predetermined low compression ratio; and perform stratified combustion in a cylinder of the internal combustion engine. Under an operation state other than the engine idling during the catalyst warming-up, the internal combustion engine is controlled in order to perform homogeneous combustion in the cylinder. The internal combustion engine is controlled in order to implement the compression ratio fixing control and perform homogeneous combustion in the cylinder, in response to pressing-down of an accelerator of the internal combustion engine under the engine idling during the catalyst warming-up, and as long as the engine idling during the catalyst warming-up has a possibility to resume in response to release of the accelerator after the pressing-down.

According to the above aspect of the present invention, the internal combustion engine is controlled in order to give priority to stability of combustion over adjustment of compression ratio depending on engine operation conditions, as long as the catalyst warming-up is incomplete. This serves to improve the internal combustion engine in combustion stability.

MODE(S) FOR CARRYING OUT THE INVENTION

The following describes an embodiment of the present invention with reference to the drawings.

Figure 1:
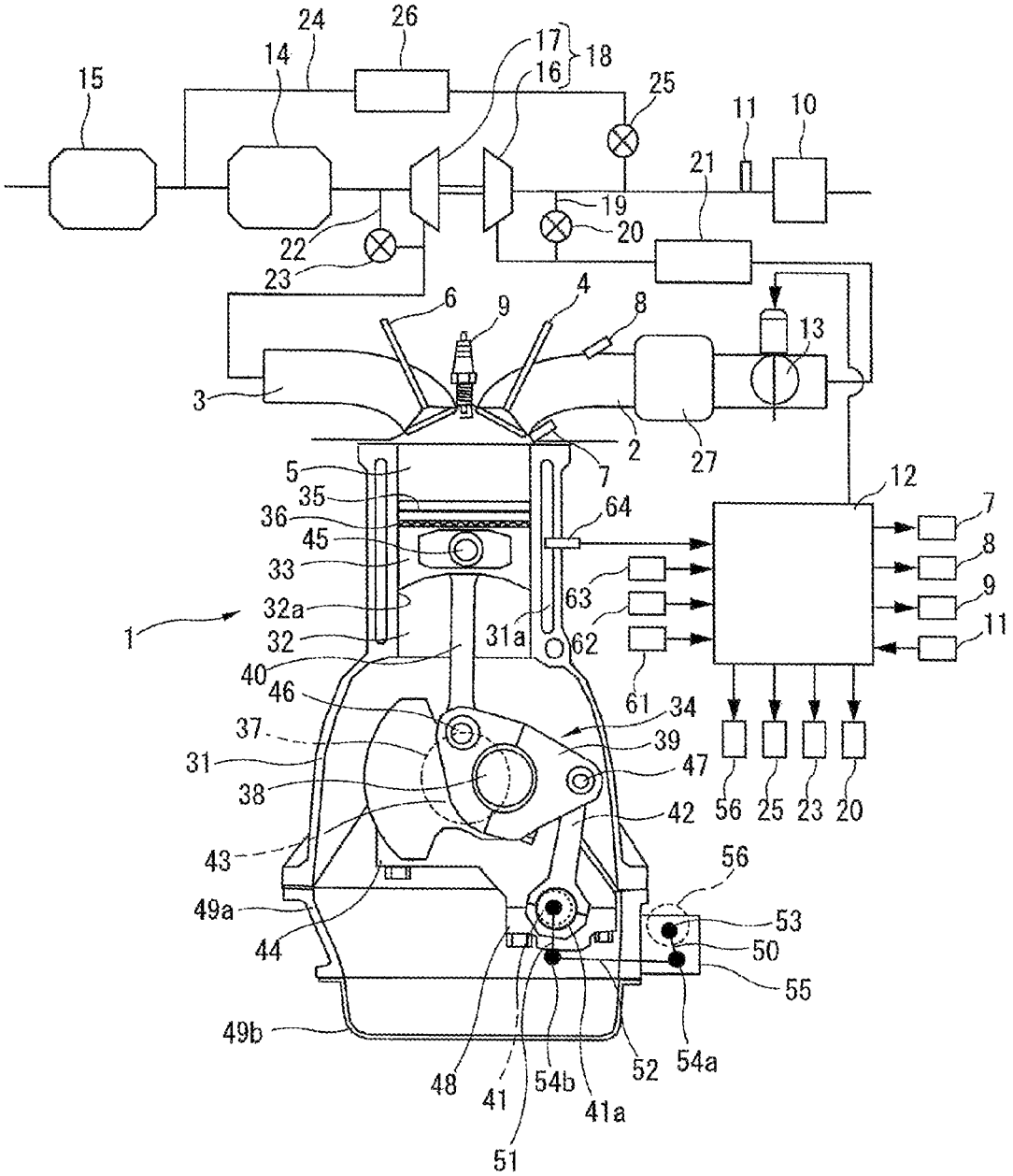
FIG. 1 is a schematic view showing configurations involving a control system for an internal combustion engine according to an embodiment of the present invention.

FIG. 1 is a schematic view showing configurations involving a control system for an internal combustion engine 1 according to the present embodiment. The configurations shown in FIG. 1 are conformance with a control method for internal combustion engine 1 according to the present embodiment.

Internal combustion engine 1 is structured as a driving source for a vehicle such as an automobile, and includes an intake passage 2, an exhaust passage 3, an intake valve 4, an exhaust valve 6, and a combustion chamber 5. Intake passage 2 is connected to combustion chamber 5 via intake valve 4. Exhaust passage 3 is connected to combustion chamber 5 via exhaust valve 6.

Internal combustion engine 1 further includes a first fuel injection valve 7, a second fuel injection valve 8, and a spark plug 9. First fuel injection valve 7 is structured to inject fuel directly into combustion chamber 5. Second fuel injection valve 8 is structured to inject fuel into intake passage 2: in detail, into an upstream side of intake passage 2 with respect to intake valve 4. The fuel injected from first fuel injection valve 7 and/or second fuel injection valve 8 is ignited by spark plug 9 in combustion chamber 5.

Intake passage 2 is provided with an air cleaner 10, an air flow meter 11, and an electric throttle valve 13 that are disposed in intake passage 2. Air cleaner 10 is structured to collect foreign substances in intake air. Air flow meter 11 is structured to measure an amount of intake air. Throttle valve 13 having an opening degree variable depending on control signal from a controller unit 12 of internal combustion engine 1.

Air flow meter 11 is disposed upstream with respect to throttle valve 13, and includes a built-in temperature sensor structured to measure a temperature of intake air at an inlet of the intake air. Air cleaner 10 is disposed upstream with respect to air flow meter 11.

Exhaust passage 3 is provided with an upstream-side exhaust catalyst 14 and a downstream-side exhaust catalyst 15 that are disposed in exhaust passage 3. Upstream-side exhaust catalyst 14 is composed of a catalyst such as a three way catalyst. Downstream-side exhaust catalyst 15 is composed of a catalyst such as a NOx-trapping catalyst, and is located downstream with respect to upstream-side exhaust catalyst 14.

Internal combustion engine 1 includes a turbocharger 18 coaxially including a compressor 16 and an exhaust turbine 17. Compressor 16 is disposed in intake passage 2, upstream with respect to throttle valve 13 and downstream with respect to air flow meter 11. Exhaust turbine 17 is disposed in exhaust passage 3, upstream with respect to upstream-side exhaust catalyst 14.

Intake passage 2 is connected to a recirculation passage 19. Recirculation passage 19 includes: a first end connected to intake passage 2 in an upstream section with respect to compressor 16; and a second end connected to intake passage 2 in a downstream section with respect to compressor 16.

Recirculation passage 19 includes an electric recirculation valve 20 structured to allow a boost pressure to be exerted from the upstream section with respect to compressor 16 toward the downstream section with respect to compressor 16. Recirculation valve 20 may employ a check valve structured to open only when a pressure in the downstream section with respect to compressor 16 is greater than a predetermined value.

Intake passage 2 is provided with an intercooler 21 disposed downstream with respect to compressor 16. Intercooler 21 is structured to cool the intake air that has been compressed (or boosted) by compressor 16, in order to improve a charging efficiency of intake air. Intercooler 21 is located downstream with respect to the second end (downstream-side end) of recirculation passage 19 and upstream with respect to throttle valve 13.

Exhaust passage 3 is connected to an exhaust bypass passage 22 for bypassing of exhaust turbine 17. Exhaust bypass passage 22 is formed to connect an upstream section and a downstream section of exhaust passage 3 with respect to exhaust turbine 17. Exhaust bypass passage 22 includes a downstream-side end connected to exhaust passage 3 at a point upstream with respect to upstream-side exhaust catalyst 14, and includes an electric waste gate valve 23 structured to control an amount of exhaust air flowing in exhaust bypass passage 22. Waste gate valve 23 allows a part of exhaust air flowing toward exhaust turbine 17 to bypass exhaust turbine 17 and flow into a point downstream with respect to exhaust turbine 17, and serves to control a boost pressure of internal combustion engine 1.

Internal combustion engine 1 is structured to perform Exhaust Gas Recirculation (EGR) in which a part of exhaust gas in exhaust passage 3 is leaded to flow into intake passage 2 (namely, recirculated) as EGR gas, and includes an EGR passage 24 formed to branch off from exhaust passage 3 and be connected to intake passage 2. EGR passage 24 has a first end connected to exhaust passage 3 at a point between upstream-side exhaust catalyst 14 and downstream-side exhaust catalyst 15, and a second end connected to intake passage 2 at a point downstream with respect to air flow meter 11 and upstream with respect to compressor 16. EGR passage 24 includes an electric EGR valve 25 and an EGR cooler 26. EGR valve 25 is structured to control an amount of EGR gas flowing in EGR passage 24. EGR cooler 26 is structured to cool the EGR gas. Incidentally, intake passage 2 includes a collector 27 as shown in FIG. 1.

Internal combustion engine 1 includes a variable compression ratio mechanism 34 structured to vary a mechanical compression ratio of internal combustion engine 1 by varying a top dead center position of a piston 33, wherein piston 33 is structured to reciprocate in a cylinder bore 32 of a cylinder block 31. Accordingly, internal combustion engine 1 has the mechanical compression ratio variable due to variation in slidable range of piston 33 being in sliding contact with an inner peripheral surface 32*a* of cylinder bore 32. In other words, internal combustion engine 1 has the mechanical compression ratio variable due to variation in slidable range of piston 33 with respect to the cylinder. The mechanical compression ratio depends on the top dead center position and a bottom dead center position of piston 33.

Piston 33 includes a first piston ring 35 and a second piston ring 36. First piston ring 35 is disposed nearer to a crown surface of piston 33 than second piston ring 36. First piston ring 35 and second piston ring 36 are so-called compression rings, and are structured to eliminate a gap between piston 33 and inner peripheral surface 32*a* of cylinder bore 32 for airtightness.

Variable compression ratio mechanism 34 employs a multi-link type piston crank mechanism in which piston 33 is in linkage with a crank pin 38 of a crank shaft 37 via links. Variable compression ratio mechanism 34 includes: a lower link 39 mounted to crank pin 38 rotatably; an upper link 40 connecting lower link 39 to piston 33; a control shaft 41 including an eccentric shaft part 41*a*; and a control link 42 connecting eccentric shaft part 41*a* to lower link 39.

Crank shaft 37 includes crank pin 38 and crank journals 43. Crank journal 43 is rotatably supported between cylinder block 31 and a crank bearing bracket 44.

Upper link 40 includes: a first end mounted rotatably to piston pin 45; and a second end connected rotatably to lower link 39 via a first connection pin 46. Control link 42 includes: a first end connected rotatably to lower link 39 via a second connection pin 47; and a second end mounted rotatably to eccentric shaft part 41*a* of control shaft 41. First connection pin 46 and second connection pin 47 are press-fitted in lower link 39.

Control shaft 41 is disposed parallel with crank shaft 37 and rotatably supported by cylinder block 31. In detail, control shaft 41 is rotatably supported between crank bearing bracket 44 and a control shaft bearing bracket 48.

Cylinder block 31 is provided with an upper oil pan 49*a* mounted to a bottom of cylinder block 31 and a lower oil pan 49*b* mounted to a bottom of upper oil pan 49*a*.

Control shaft 41 is structured to be driven due to rotation of a drive shaft 53 transmitted via a first arm 50, a second arm 51, and an intermediary arm 52. Drive shaft 53 is parallel with control shaft 41, and is disposed outside of upper oil pan 49*a*, and is connected to first arm 50. Intermediary arm 52 is disposed to connect first arm 50 to second arm 51.

Intermediary arm 52 includes a first end connected to first arm 50 via a pin 54*a*, and a second end connected to second arm 51 via a pin 54*b*, wherein second arm 51 is connected to control shaft 41.

Drive shaft 53, first arm 50, and the first end of intermediary arm 52 is contained in a housing 55 mounted to an outer periphery of upper oil pan 49*a*.

Drive shaft 53 includes an end connected to an electric motor 56 via a speed reducer not shown. Electric motor 56 serves as an actuator structured to cause the rotation of drive shaft 53. The speed reducer is structured to reduce a rotational speed of drive shaft 53 with respect to a rotational speed of electric motor 56.

Due to rotation of electric motor 56, drive shaft 53 rotates, and intermediary arm 52 reciprocates along a plane perpendicular to drive shaft 53. The reciprocation of intermediary arm 52 causes a connection point between intermediary arm 52 and second arm 51 to swing, and then causes control shaft 41 to rotate. The rotation of control shaft 41 causes variation in rotational position of control shaft 41, and then causes variation in position of eccentric shaft part 41*a* serving as a supporting point for swing of control link 42. Thus, electric motor 56 is structured to cause variation in rotational position of control shaft 41, and variation in attitude of lower link 39, and variation in top dead center position and bottom dead center position of piston 33. This allows the mechanical compression ratio of internal combustion engine 1 to vary continuously.

The rotation of electric motor 56 is controlled by controller unit 12. Accordingly, variable compression ratio mechanism 34 varies or fixes the mechanical compression ratio of internal combustion engine 1 under control of controller unit 12.

Controller unit 12 is configured to control the electric motor 56 such that the mechanical compression ratio of internal combustion engine 1 has a value corresponding to engine operation conditions. For example, controller unit 12 stores a map of target compression ratio employing an engine load and an engine speed of internal combustion engine 1 as parameters representing the engine operation conditions, and is configured to set a target compression ratio with reference to the map. The target compression ratio is basically set high in response to a low engine load, and lowered in response to increase in engine load in view of reduction of knocking etc.

The target compression ratio map contains values of the target compression ratio that are predetermined to be optimum in view of fuel efficiency.

Controller unit 12 is a known digital computer including a CPU, a ROM, a RAM, and an input-output interface.

Controller unit 12 receives measurement signals from various sensors such as: air flow meter 11 described above; a crank angle sensor 61 structured to measure a crank angle of crank shaft 37; an accelerator-opening sensor 62 structured to measure an amount of press-down of the accelerator; a rotational angle sensor 63 structured to measure a rotational angle of drive shaft 53; and a water temperature sensor 64 structured to measure a temperature Tw of cooling-water. Controller unit 12 is configured to calculate a required engine load of internal combustion engine 1, based on a measurement of accelerator-opening sensor 62.

Crank angle sensor 61 serves to measure the engine speed of internal combustion engine 1.

Water temperature sensor 64 measures the temperature of cooling-water in a water jacket 31*a* formed in cylinder block 31.

Based on the measurement signals from the various sensors, controller unit 12 suitably controls: an amount and a timing of fuel injection performed by first fuel injection valve 7 and/or second fuel injection valve 8; an ignition timing of spark plug 9; the opening degree of throttle valve 13; an opening degree of recirculation valve 20; an opening degree of waste gate valve 23; an opening degree of EGR valve 25; and the mechanical compression ratio of internal combustion engine 1 defined by variable compression ratio mechanism 34.

Moreover, controller unit 12 is configured to switch form of combustion in the cylinder (i.e. in combustion chamber 5) between two options, depending on the engine operation conditions. The two options are stratified combustion and homogeneous combustion. For the stratified combustion, the fuel injection is implemented during a compression stroke in order to form concentrated fuel-air mixture around spark plug 9 upon ignition. For the homogeneous combustion, the fuel injection is implemented during an intake stroke in order to promote diffusion of fuel and form homogeneous fuel-air mixture in combustion chamber 5 upon ignition. Thus, controller unit 12 serves as a controller of the combustion form in the cylinder.

Furthermore, controller unit 12 determines that upstream-side exhaust catalyst 14 and downstream-side exhaust catalyst 15 require warming-up, in response to satisfaction of a condition that the cooling-water temperature Tw measured by water temperature sensor 64 is lower than a predetermined threshold water temperature Twth. Thus, controller unit 12 serves also as a determiner configured to determine whether the warming-up of upstream-side exhaust catalyst 14 and downstream-side exhaust catalyst 15 is complete. In addition, controller unit 12 serves to determine whether upstream-side exhaust catalyst 14 and downstream-side exhaust catalyst 15 have catalyst temperatures lower than a predetermined activation temperature.

When the catalyst temperatures are lower than the predetermined activation temperature, upstream-side exhaust catalyst 14 and downstream-side exhaust catalyst 15 do not exert expected efficiency in purification of exhaust gas.

Under such condition that the catalyst temperatures of upstream-side exhaust catalyst 14 and downstream-side exhaust catalyst 15 are low, it is effective to lower the mechanical compression ratio of internal combustion engine 1 and thereby raise a temperature of exhaust gas, in order to promote the catalyst warming-up.

For the warming-up of upstream-side exhaust catalyst 14 and downstream-side exhaust catalyst 15, it is also effective to control the combustion form in the cylinder (i.e. in combustion chamber 5) to the stratified combustion, and thereby raise the exhaust gas temperature in combustion chamber 5. Under the stratified combustion, it is allowed to increase a retard quantity of ignition timing.

According to the present embodiment, under engine idling during the catalyst warming-up of upstream-side exhaust catalyst 14 and downstream-side exhaust catalyst 15, internal combustion engine 1 is controlled in order to: implement a compression ratio fixing control in which the mechanical compression ratio of internal combustion engine 1 is fixed to a predetermined low compression ratio; perform the stratified combustion in the cylinder (i.e. in combustion chamber 5); and set the ignition timing posterior to compression top dead center.

In detail, under the engine idling during the catalyst warming-up, internal combustion engine 1 is controlled in order to: implement the compression ratio fixing control while control the combustion form in the cylinder to the stratified combustion in which the quantity of retard in ignition timing may be increased; increase the opening degree of throttle valve 13 and thereby increase the amount of intake air; set the ignition timing to a super-retarded ignition timing posterior to the compression top dead center; and raise the exhaust gas temperature while maintaining the engine speed at a predetermined idling engine speed. This serves to promote the warming-up of upstream-side exhaust catalyst 14 and downstream-side exhaust catalyst 15 under the engine idling during the catalyst warming-up.

The compression ratio fixing control is configured to fix the mechanical compression ratio of internal combustion engine 1 to the predetermined low compression ratio. This causes decrease in thermal efficiency and promotes the rise in exhaust gas temperature.

Under an engine operation state other than the engine idling during the catalyst warming-up of upstream-side exhaust catalyst 14 and downstream-side exhaust catalyst 15, internal combustion engine 1 is controlled in order to implement a compression ratio normal control in which the mechanical compression ratio of internal combustion engine 1 is varied depending on the engine operation conditions. In such case, the combustion form in the cylinder is controlled to the homogeneous combustion, and the ignition timing is set to a predetermined normal ignition timing at or in a vicinity of Minimum advance for the Best Torque (MBT). MBT is an ignition timing best in view of engine output, fuel efficiency, etc.

In response to pressing-down of the accelerator under the engine idling during the catalyst warming-up of upstream-side exhaust catalyst 14 and downstream-side exhaust catalyst 15, internal combustion engine 1 is controlled in order to implement the compression ratio fixing control, and control the combustion form to the homogeneous combustion, and set the ignition timing to the predetermined normal ignition timing at or in the vicinity of MBT, as long as the engine idling during the catalyst warming-up has a possibility to resume due to release of the accelerator after the pressing-down.

In detail, as long as the engine idling during the catalyst warming-up has the possibility to resume due to the release of the accelerator after the pressing-down of the accelerator under the engine idling during the catalyst warming-up, internal combustion engine 1 is controlled in order to: maintain the mechanical compression ratio of internal combustion engine 1 at the predetermined low compression ratio unchanged from that for the engine idling during the catalyst warming-up; control the combustion form to the homogeneous combustion; and adjust the throttle opening (i.e. the opening degree of throttle valve 13) to obtain the intake air sufficient in amount to achieve a target torque, given that the ignition timing is set to the predetermined normal ignition timing at or in the vicinity of MBT.

The setting of the ignition timing and the adjusting of the throttle opening are executed on the premise that the mechanical compression ratio of internal combustion engine 1 is maintained at the predetermined low compression ratio.

In response to the pressing-down of the accelerator under the engine idling during the catalyst warming-up, it is favorable in view of fuel efficiency to switch compression ratio operation from the compression ratio fixing control to the compression ratio normal control, in order to raise the mechanical compression ratio of internal combustion engine 1. However, such manner results in, if the catalyst warming-up is incomplete at a timing of the resumption of engine idling, that the mechanical compression ratio is lowered again to the predetermined low compression ratio and simultaneously the combustion form is switched from the homogeneous combustion to the stratified combustion. This may cause, depending on accelerator operation, the switching of the compression ratio operation and the switching of the combustion form to occur simultaneously and frequently, and may cause internal combustion engine 1 to undergo unstable combustion, as long as the catalyst warming-up is incomplete.

In view of the foregoing, according to the present embodiment, internal combustion engine 1 under the engine idling is controlled in order to implement the compression ratio fixing control and control the combustion form in the cylinder to the stratified combustion, as long as the warming-up of upstream-side exhaust catalyst 14 and downstream-side exhaust catalyst 15 is incomplete. Internal combustion engine 1 under an operating state other than the engine idling (i.e. under engine non-idling) is controlled in order to implement the compression ratio fixing control and control the combustion form to the homogeneous combustion, as long as the catalyst warming-up is incomplete.

Thus, internal combustion engine 1 is controlled in order to give priority to stability of combustion over adjustment of the mechanical compression ratio depending on the engine operation conditions, as long as the warming-up of upstream-side exhaust catalyst 14 and downstream-side exhaust catalyst 15 is incomplete. This serves to secure the combustion stability of internal combustion engine 1.

In case that the accelerator is pressed down under the engine idling during the warming-up of upstream-side exhaust catalyst 14 and downstream-side exhaust catalyst 15 and then the catalyst warming-up is completed with the accelerator pressed-down, internal combustion engine 1 is controlled in order to finish the compression ratio fixing control and start the compression ratio normal control in response to the completion of the catalyst warming-up.

This serves to minimize influence on operation performance of internal combustion engine 1.

Furthermore, after the completion of the warming-up of upstream-side exhaust catalyst 14 and downstream-side exhaust catalyst 15, internal combustion engine 1 is controlled in order to implement the compression ratio normal control to control the mechanical compression ratio to a value optimum in view of fuel efficiency. This serves to minimize influence on the fuel efficiency of internal combustion engine 1.

Figure 2:
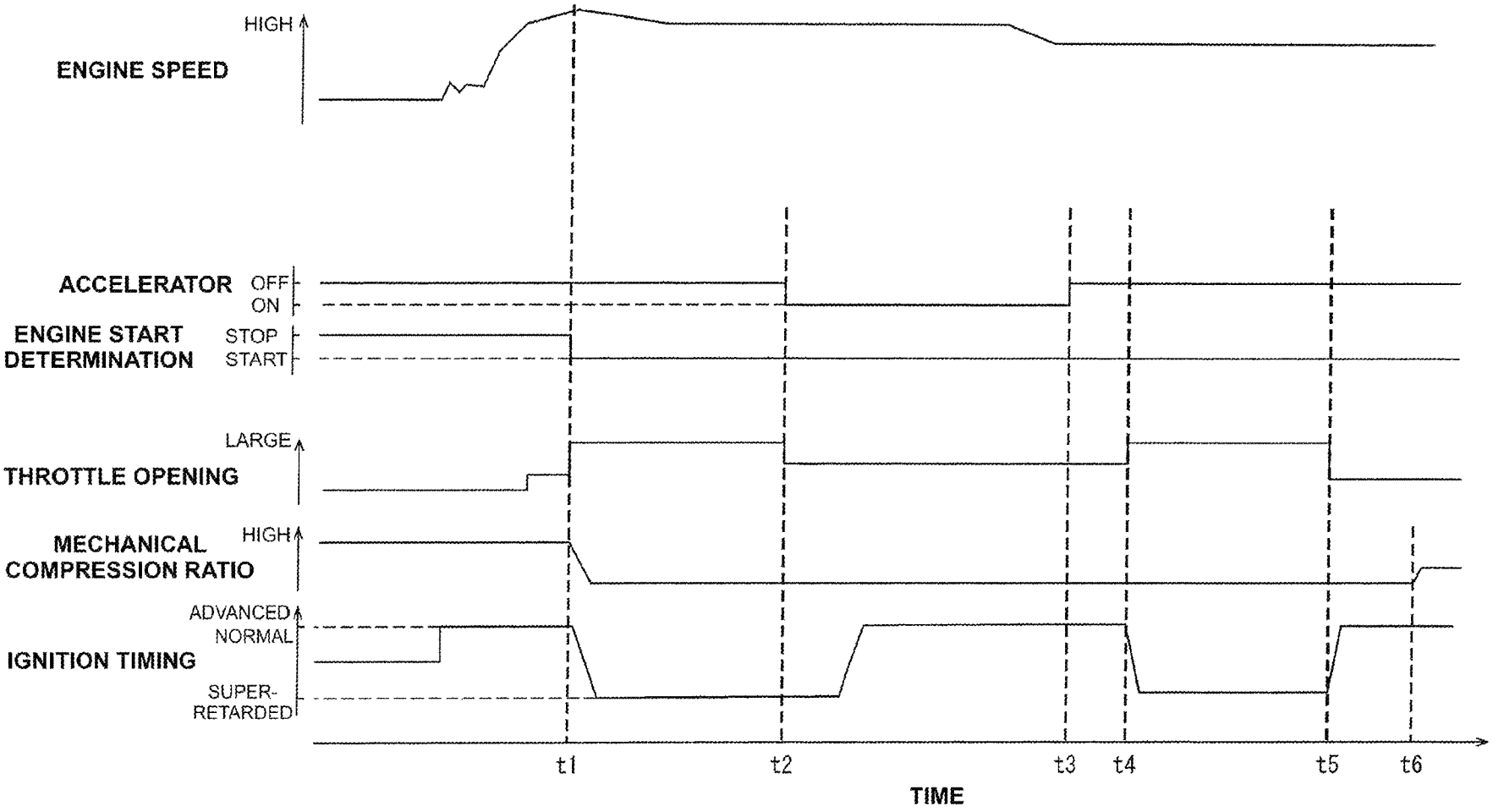
FIG. 2 is a timing chart showing an exemplary control for cold starting of the internal combustion engine.

FIG. 2 is a timing chart showing an exemplary control for cold starting of internal combustion engine 1. After internal combustion engine 1 has been set to start, at a time instant t1, internal combustion engine 1 exceeds a predetermined value in engine speed and reaches a state of complete explosion. In other words, at time instant t1, the engine speed of internal combustion engine 1 exceeds the predetermined value being a threshold for enabling internal combustion engine 1 to perform self-sustaining rotation, and completes cranking.

Internal combustion engine 1 is determined to have started at time instant t1. Simultaneously, the control for the mechanical compression ratio of internal combustion engine 1 starts at time instant t1. At time instant t1, the accelerator has not been pressed down (i.e. the accelerator is OFF), and upstream-side exhaust catalyst 14 and downstream-side exhaust catalyst 15 have the catalyst temperatures lower than the predetermined activation temperature.

Then, the compression ratio fixing control starts at time instant t1 in order to fix the mechanical compression ratio of internal combustion engine 1 to the predetermined low compression ratio (e.g. compression ratio 9.5).

From time instant t1 on, internal combustion engine 1 is controlled in order to control the combustion form to the stratified combustion, and set the ignition timing to the super-retarded ignition timing posterior to the compression top dead center.

From time instant t1 on, the throttle opening is set to an opening degree to obtain the intake air sufficient in amount for the stratified combustion: namely, set to an opening degree for the catalyst warming-up.

The mechanical compression ratio of internal combustion engine 1 is fixed at a compression ratio for start (e.g. compression ratio 14) until the completion of the cranking of internal combustion engine 1. The ignition timing of internal combustion engine 1 is set to the predetermined normal ignition timing at or in the vicinity of MBT, until the completion of the cranking of internal combustion engine 1.

At a time instant t2, the accelerator is pressed down (i.e. becomes ON), while the catalyst temperatures of upstream-side exhaust catalyst 14 and downstream-side exhaust catalyst 15 are still lower than the predetermined activation temperature.

From time instant t2 on, internal combustion engine 1 is controlled in order to switch the combustion form to the homogeneous combustion, while the mechanical compression ratio of internal combustion engine 1 is still maintained at the predetermined low compression ratio.

The ignition timing of internal combustion engine 1 is switched to the predetermined normal ignition timing at or in the vicinity of MBT, after a predetermined time period from time instant t2.

From time instant t2 on, the throttle opening is set not to the opening degree to obtain the intake air sufficient in amount for the stratified combustion, but to an opening degree for target torque achievement sufficient to achieve the target torque calculated based on the engine operation conditions.

Internal combustion engine 1 does not start to switch the ignition timing at time instant t2 at which the accelerator becomes ON, in view of stability of control.

At a time instant t3, the accelerator is released (i.e. becomes OFF), while the catalyst temperatures of upstream-side exhaust catalyst 14 and downstream-side exhaust catalyst 15 are still lower than the predetermined activation temperature.

From a time instant t4 on, internal combustion engine 1 is controlled in order to switch the combustion form to the stratified combustion, wherein time instant t4 is a time instant after a predetermined time period from time instant t3. The mechanical compression ratio of internal combustion engine 1 is still maintained at the predetermined low compression ratio.

Internal combustion engine 1 starts to switch the ignition timing to the super-retarded ignition timing, at time instant t4.

The throttle opening is adjusted to obtain the intake air sufficient in amount for the stratified combustion, from time instant t4 on.

In view of the stability of control, internal combustion engine 1 does not start to switch the combustion form and the ignition timing at time instant t3 at which the accelerator becomes OFF.

At a time instant t5, the catalyst temperatures of upstream-side exhaust catalyst 14 and downstream-side exhaust catalyst 15 are determined to have exceeded the predetermined activation temperature.

Then, from time instant t5 on, internal combustion engine 1 is controlled in order to switch the combustion form to the homogeneous combustion, and set the ignition timing to the predetermined normal ignition timing at or in the vicinity of MBT.

From time instant t5 on, the throttle opening is set not to the opening degree to obtain the intake air sufficient in amount for the stratified combustion, but to the opening degree for target torque achievement.

From a time instant t6 on, the mechanical compression ratio of internal combustion engine 1 is controlled to the target compression ratio based on the target compression ratio map employing as parameters the engine load and the engine speed of internal combustion engine 1, wherein time instant t6 is a time instant after a predetermined time period from time instant t5. In other words, the compression ratio normal control starts at time instant t6.

Between time instants t5 and t6, the mechanical compression ratio of internal combustion engine 1 is still maintained at the predetermined low compression ratio.

In view of the stability of control, internal combustion engine 1 does not start at time instant t5 to control the mechanical compression ratio to the target compression ratio based on the target compression ratio map.

Figure 3:
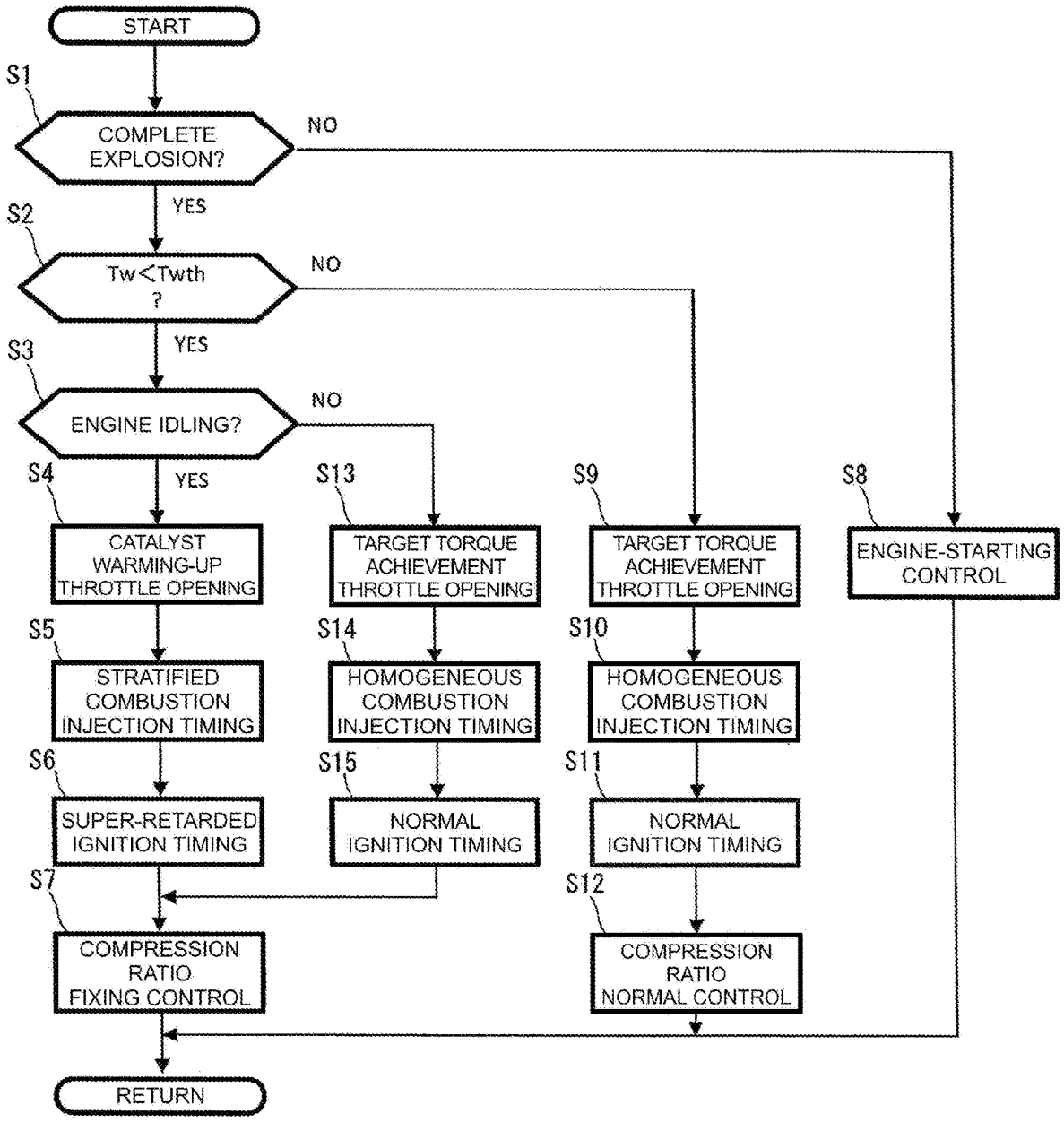
FIG. 3 is a flow chart showing a control flow of the internal combustion engine.

FIG. 3 is a flow chart showing a control flow of internal combustion engine 1 according to the embodiment described above.

Step S1 is determination on whether internal combustion engine 1 is in the state of complete explosion. In other words, step S1 is determination on whether the start of internal combustion engine 1 is completed. Internal combustion engine 1 is determined to have reached the state of complete explosion, in response to satisfaction of a condition that the engine speed exceeds the predetermined value. In case that internal combustion engine 1 is in the state of complete explosion, step S2 is executed. In case that internal combustion engine 1 is not in the state of complete explosion, step S8 is executed.

Step S2 is determination on whether the cooling-water temperature Tw measured by water temperature sensor 64 is lower than the threshold water temperature Twth. In case that the cooling-water temperature Tw is lower than the threshold water temperature Twth, step S3 is executed. In case that the cooling-water temperature Tw is equal to or higher than the threshold water temperature Twth, step S9 is executed. Step S2 means determination on whether the warming-up of upstream-side exhaust catalyst 14 and downstream-side exhaust catalyst 15 is complete.

Step S3 is determination on whether internal combustion engine 1 is in the state of engine idling. In response to the accelerator OFF (i.e. the state that the accelerator is not pressed down), internal combustion engine 1 is determined to be in the state of engine idling, and step S4 is executed. In case that internal combustion engine 1 is not in the state of engine idling, step S13 is executed.

Step S4 is setting of the throttle opening to the opening degree for the catalyst warming-up.

Step S5 is setting of the fuel injection timing for the stratified combustion. The fuel injection for the stratified combustion is exemplarily performed during a compression stroke.

Step S6 is setting of the ignition timing to the super-retarded ignition timing.

Step S7 is implementation of the compression ratio fixing control in which the mechanical compression ratio of internal combustion engine 1 is fixed to the predetermined low compression ratio, after which a routine at this time is finished.

Step S8 is implementation of an engine-starting control for the cranking of internal combustion engine 1, after which the routine at this time is finished. The engine-starting control exemplarily includes driving a starter motor not shown and thereby driving crank shaft 37 of internal combustion engine 1.

Step S9 is setting of the throttle opening to the opening degree for target torque achievement sufficient to achieve the target torque based on the engine operation conditions.

Step S10 is setting of the fuel injection timing for the homogeneous combustion. The fuel injection for the homogeneous combustion is exemplarily performed during an intake stroke.

Step S11 is setting of the ignition timing of internal combustion engine 1 to the predetermined normal ignition timing at or in the vicinity of MBT.

Step S12 is implementation of the compression ratio normal control, after which the routine at this time is finished.

Step S13 is setting of the throttle opening to the opening degree for target torque achievement sufficient to achieve the target torque based on the engine operation conditions.

Step S14 is setting of the fuel injection timing for the homogeneous combustion. The fuel injection for the homogeneous combustion is exemplarily performed during an intake stroke.

Step S15 is setting of the ignition timing of internal combustion engine 1 to the predetermined normal ignition timing at or in the vicinity of MBT, after which step S7 is executed.

The embodiment described above relates to a control method for internal combustion engine, and a control system for internal combustion engine.

The invention claimed is:

1. A control method for an internal combustion engine including a variable compression ratio mechanism structured to vary a mechanical compression ratio of the internal combustion engine, the control method comprising:

determining whether warming-up of a catalyst disposed in an exhaust passage of the internal combustion engine is completed;

implementing a compression ratio fixing control in which the mechanical compression ratio is fixed to a predetermined low compression ratio, and controlling combustion form in a cylinder of the internal combustion engine to stratified combustion, under engine idling during the warming-up of the catalyst;

controlling the combustion form in the cylinder to homogeneous combustion, under an operation state other than the engine idling during the warming-up of the catalyst; and implementing the compression ratio fixing control and controlling the combustion form in the cylinder to the homogeneous combustion, in response to pressing-down of an accelerator of the internal combustion engine under the engine idling during the warming-up of the catalyst, and as long as the engine idling during the warming-up of the catalyst has a possibility to resume in response to release of the accelerator after the pressing-down.

2. The control method as claimed in claim 1, further comprising:

finishing the compression ratio fixing control and starting a compression ratio normal control in which the mechanical compression ratio is varied depending on engine operation conditions, in response to satisfaction of a condition that the accelerator is pressed down under the engine idling during the warming-up of the catalyst and thereafter the warming-up of the catalyst is completed with the accelerator pressed down.

3. The control method as claimed in claim 2, wherein the compression ratio normal control is configured to control the mechanical compression ratio to a value optimum in view of fuel efficiency.

4. The control method as claimed in claim 1 any one of claims 1 to 3, wherein the warming-up of the catalyst is determined to be completed, in response to satisfaction of a condition that cooling-water of the internal combustion engine has a temperature equal to or higher than a predetermined value.

5. A control system for an internal combustion engine, the control system comprising:

a catalyst disposed in an exhaust passage of the internal combustion engine;

a determiner structured to determine whether warming-up of the catalyst is completed;

a variable compression ratio mechanism structured to vary a mechanical compression ratio of the internal combustion engine; and a controller configured to:

implement a compression ratio fixing control in which the mechanical compression ratio is fixed to a predetermined low compression ratio, and control combustion form in a cylinder of the internal combustion engine to stratified combustion, under engine idling during the warming-up of the catalyst;

control the combustion form in the cylinder to homogeneous combustion, under an operation state other than the engine idling during the warming-up of the catalyst; and implement the compression ratio fixing control and control the combustion form in the cylinder to the homogeneous combustion, in response to pressing-down of an accelerator of the internal combustion engine under the engine idling during the warming-up of the catalyst, and as long as the engine idling during the warming-up of the catalyst has a possibility to resume in response to release of the accelerator after the pressing-down.

* * * * *